United States Patent [19]

Van Benthusysen et al.

[11] Patent Number: 4,751,385

[45] Date of Patent: Jun. 14, 1988

[54] LIGHTED CONTACT SWITCH

[75] Inventors: John Van Benthusysen; John Zdanys, Jr., both of Elkhart, Ind.

[73] Assignee: CTS Corporation, Elkhart, Ind.

[21] Appl. No.: 906,132

[22] Filed: Sep. 11, 1986

Related U.S. Application Data

[63] Continuation-in-part of Ser. No. 677,514, Dec. 3, 1984, abandoned.

[51] Int. Cl.[4] ..... H01H 9/18

[52] U.S. Cl. ..... 200/314; 200/275; 200/284

[58] Field of Search ..... 200/314, 275, 284, 67 DB

[56] References Cited

U.S. PATENT DOCUMENTS

| | | | |
|---|---|---|---|
| 3,306,998 | 2/1967 | Russell | 200/67 DB |
| 3,754,243 | 8/1973 | Kaneko et al. | 200/314 |
| 3,863,040 | 1/1975 | Van Benschoten et al. | 200/67 DB |
| 3,917,917 | 11/1975 | Murata | 200/67 DB |
| 3,989,912 | 11/1976 | Francke | 200/159 A |
| 4,002,873 | 1/1977 | Lewandowski | 200/314 |
| 4,346,275 | 8/1982 | Iwakiri et al. | 200/314 |
| 4,354,077 | 10/1982 | McMains et al. | 200/314 |
| 4,370,532 | 1/1983 | Green | 200/314 |
| 4,385,219 | 5/1983 | Finlayson | 200/159 A |
| 4,484,042 | 11/1984 | Matsui | 200/159 A |

*Primary Examiner*—Renee S. Luebke

*Attorney, Agent, or Firm*—Rodger H. Flagg

[57] ABSTRACT

A lighted contact switch comprising: a non-conductive housing; a conductive biased spring member in electrical contact with a first terminal disposed in the housing base, and adapted to provide electrical contact with a second terminal disposed in the housing base when the biased spring member is depressed; an actuator positioned adjacent to the biased spring member; and a cap adapted with opposing tabs sized to engage and secure the cap to the actuator at assembly. The lighted switch includes opposing lamp terminals disposed at one end within the actuator sides, and extending at the opposite end through apertures in the housing base, the lamp is releasably secured between the lamp terminals and may be independently illuminated by electrical communication with the lamp terminals extending from the base. Graphics, lettering or numbering may be marked upon a translucent insert secured to the cap to identify the switching function. For non-lighted use, the switch may be assembled without the lamp.

20 Claims, 3 Drawing Sheets

LIGHTED CONTACT SWITCH

This application is a continuation-in-part of application Ser. No. 677,514 filed Dec. 3, 1984, now abandoned.

TECHNICAL FIELD

A low cost, miniature lighted contact switch of high reliability and long service life, is disclosed. The lamp may be removed and replaced by removing the cap without removing the mounted switch housing or terminals from the substrate. With cap removed, the disclosed switch may be sealed with tape for cleaning following flow soldering.

BACKGROUND ART

U.S. Pat. No. 4,370,532 teaches the use of a removable key cap with locking detent, and a flanged light pipe to transmit illumination through the opaque key cap.

U.S. Pat. No. 4,002,873 teaches a push button switch telescopically mounted on a switch base with a plurality of outwardly extending arms positioned between the button and the base. Some of these arms receive the actuating force of the button, while others provide contact with terminals in the base. Light is transmitted from an illuminating means in the base through an opening in the contact towards a light transmissive portion of the button.

U.S. Pat. No. 4,354,077 teaches use of the outer shell as the main structural member wherein front relamping and a sealed snap disk are employed.

U.S. Pat. No. 3,989,912 teaches bending back lamp leads to contact terminals in the lamp base.

U.S. Pat. No. 4,346,275 teaches the use of guide legs to secure the frame to the holder for securement, and the use of a removable transparent cap.

U.S. Pat. No. 4,385,219 teaches the mounting of the lamp independent of the movement of the push button switch by routing the lamp leads through slots in the plunger and along channels in the upper and lower housing to contact the lamp leads directly to the printed circuit board. This configuration does not allow removal or replacement of the lamp without first unsoldering or breaking the lamp leads.

BACKGROUND ART

The need for an improved, low cost, lighted contact switch of high reliability, suitable for miniaturization, has become apparent in industries using push button switches. Space is at a premium in many electronic contact switch applications, necessitating the use of smaller, less space consuming mounting configurations.

One problem encountered with switch miniaturization is the frictional wear on the bearing surface of the switch components resulting from repeated manual operation of the switch. To minimize wear, a high strength bearing material is needed, as well as a way to extend the distance between bearing points to strengthen the assembly. High strength bearing materials are rarely translucent, so what is needed is a way to pass light through the switch cap to illuminate graphics, lettering or numbering marked upon the cap to identify the switching function. Heat buildup from the enclosed lamp is also a problem, requiring the use of a high temperature material in proximity to the lamp.

Where contact switches are flow soldered to a substrate, it is preferred to be able to remove or replace the lamp without removing the switch from the substrate. Further, it is desirable to protect the switch interior from flux, solvent, detergent solutions and vapors during the substrate washing procedure.

DISCLOSURE OF THE INVENTION

The present invention provides an improved lighted contact switch Novel lamp terminals secure the lamp in position within the housing, while allowing removal of the cap from the actuator to enable replacement of the lamp without removing the housing from the substrate. The biased spring member not only provides push contact with a high cycle life, but additionally serves to provide electrical contact between terminals through the conductive biased spring material when the contact switch is depressed. The disclosed lighted contact switch is readily adaptable to miniaturization, as the component parts are minimized, and the bearing surfaces between the cap and the housing are extended to improve bearing life while allowing for reasonable tolerances between molded parts.

Therefore, one object of the invention is to provide an improved, lighted contact switch.

Another object is to provide an improved, lighted contact switch having a conductive, biased spring member which provides a conductive path between terminals when the cap is depressed.

Yet another object is to provide a novel lamp terminal with one end adapted to support and releasably secure the lamp within the housing, while the opposite end is adapted to extend beyond the housing to provide a conductive means suitable for illuminating the lamp, independently of actuation of the contact switch.

The above-mentioned and other features and objects of this invention and the manner of attaining them will become more apparent and the invention itself will be best understood by reference to the following description of an embodiment of the invention, when considered in conjunction with the accompanying drawings.

BEST MODE FOR CARRYING OUT THE INVENTION

The subject matter which I regard as my invention is particularly pointed out and distinctly claimed in the claims. The structure and operation of my invention, together with further objects and advantages, may be better understood from the following description given in connection with the accompanying drawings.

Figure 1:
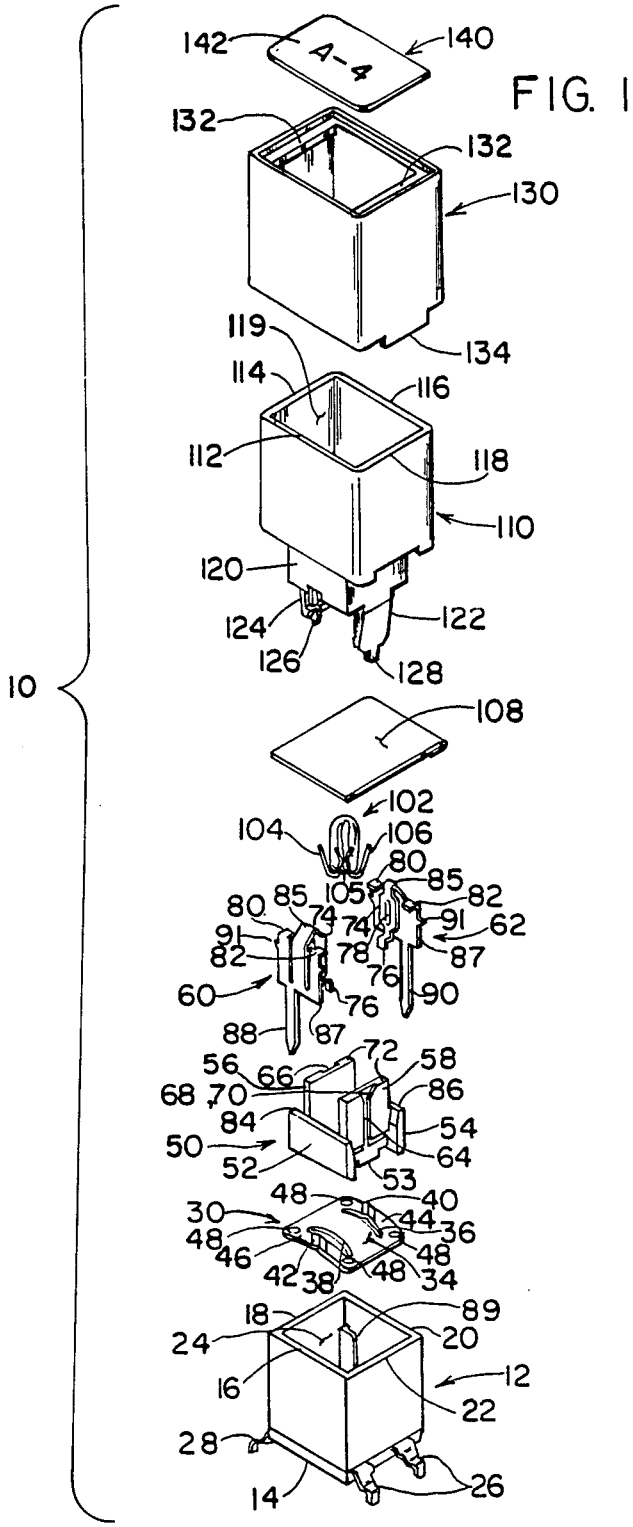
FIG. 1 is an isometric exploded view of the lighted contact switch.
Figure 2A:
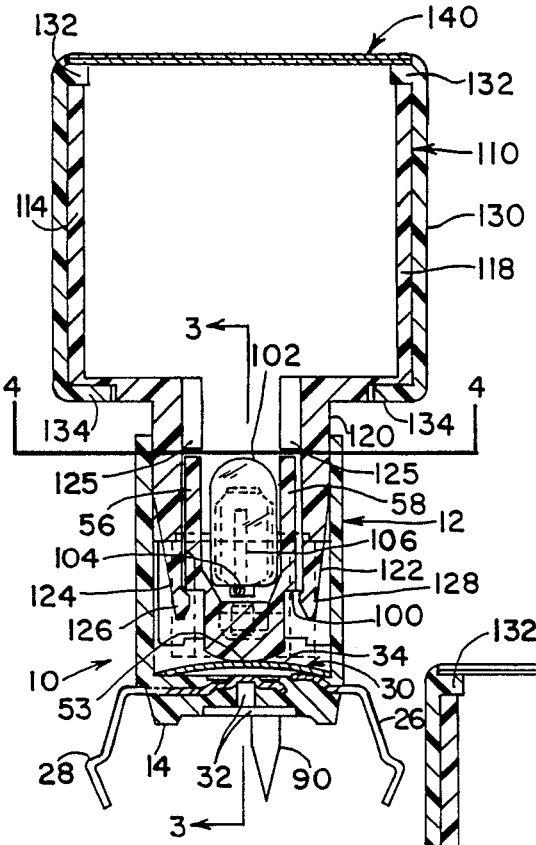
FIG. 2A is a cross sectional view of the assembled lighted switch shown in open position.
Figure 2B:
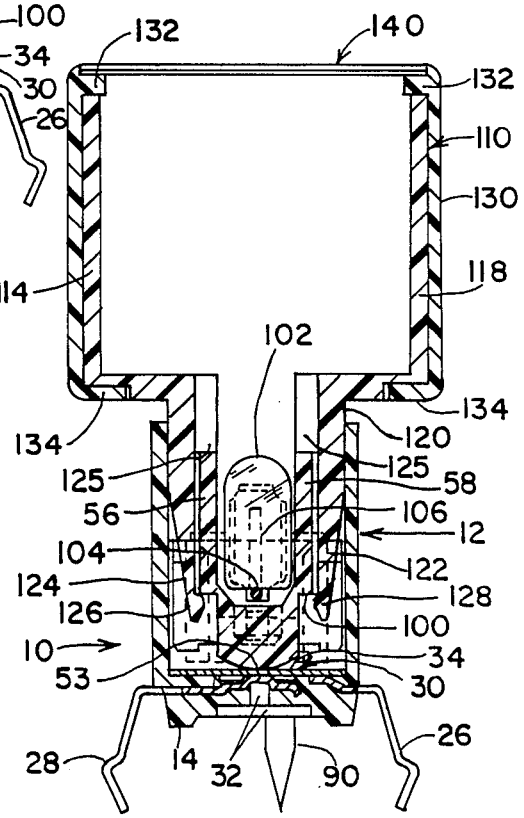
FIG. 2B is a cross sectional view of the assembled lighted switch shown in closed position.
Figure 4:
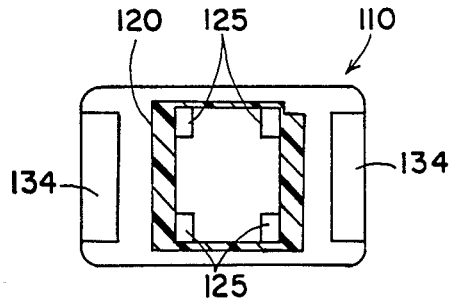
FIG. 4 is a cross sectional view of the lighted contact switch taken along lines 4—4 in FIG. 2A.

As shown in FIG. 1, the lighted contact switch 10, includes a non-conductive housing 12, having a base 14, and sides 16, 18, 20 and 22, forming an aperture 24 therebetween. Conductive terminals 26, 28 are located within housing base 14. As shown in FIGS. 2A and 2B at least one first terminal 26 is disposed in the base 14 in a manner to provide continuous electrical contact with conductive biased spring member 30. As biased spring member 30 is depressed as shown in FIG. 2B, a portion of the biased spring is adapted to make electrical contact with at least one second terminal 28. Terminals 26, 28 may be molded in place, or positioned within apertures in base 14, and then secured in place with epoxy 32. In either event as shown in FIG. 2A, the biased spring member 30 is disposed in opening 24 adjacent to base 14, with a convex portion 34 raised above housing base 14, and positioned to avoid contact with centrally disposed second terminal 28 when actuator 50 is not depressed. Biased spring 30 may be economically stamped with slots 36, 38 therein, and formed into the convex shape shown in FIG. 1 by forming ridges 40, 42 in biased spring member 30 across sides 44, 46. Ridges 40, 42 are preferably formed at an angle in relation to the sides to resist straightening during repeated switch actuation. Ridges 40, 42 serve to shorten sides 44, 46, causing a convex raised portion 34 to form between slots 36, 38. Preferably, bosses 48 are positioned to provide continuous electrical contact between biased spring 30 and at least one first terminal 26.

Actuator 50 is preferably molded from an impact resistant, high temperature non-conductive material. Actuator 50 has opposed lower bearing sides 52, 54 thereon, sized to be slidably received within housing aperture 24 between opposing guides 89. Actuator 50 has opposing sides 56, 58 disposed in spaced relation between bearing sides 52, 54. Sides 56, 58 are adapted with guide bar channels 64, 66 having inclined sides 68, 70 at end 72. End 53 of sides 56, 58 is positioned to engage the convex raised portion 34 of biased spring member 30. When actuator 50 is depressed, end 53 depresses raised portion 34 of spring member 30, to make contact between portion 34 and at least one second terminal 28.

Figure 3:
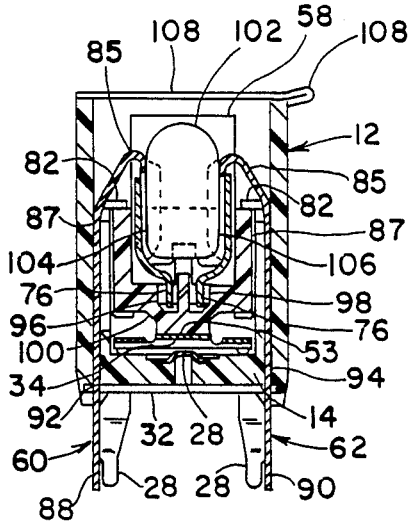
FIG. 3 is a cross sectional view of the switch with cap removed, taken along lines 3—3 in FIG. 2A, wherein a tape seal is shown in position to seal the switch in preparation for flow soldering the switch to a substrate.
Figure 5:
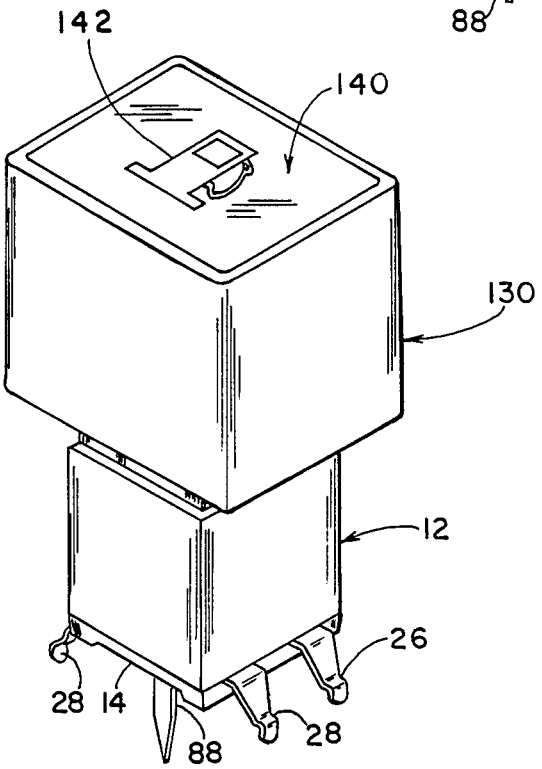
FIG. 5 is an assembled isometric view of the lighted contact switch.

Opposing lamp terminals 60, 62 are formed with tabs 76 and indentation 78 disposed in lamp end 74. Lamp end 74 is sized to be received between sides 56, 58 of actuator 50. Terminals 60, 62 are formed to extend over bearing edges 84, 86 of actuator 50 and are bent back at 85 towards base 14 of housing 12. Terminals 60, 62 each have side tabs 80, 82 positioned to contact actuator bearing edges 84, 86 of actuator 50 when the switch cap 110 is not depressed, to limit travel of actuator 50 within housing 12. Terminals 60, 62 each have narrow terminals 88, 90 formed to extend through apertures 92, 94 in base 14 as shown in FIG. 3. Terminals 88, 90 may be energized with electrical voltage independently of terminals 26 or 28, such as for use in an automotive dash board, where lamp illumination is controlled by a remote lighting control switch (not shown). Alternately, terminals 60, 62 may be adapted for communication with terminal 28 and ground or an extrnal voltage and ground (not shown) to conduct electrical voltage through lamp terminals 88, 90 when switch cap 110 is depressed.

At assembly, as shown in FIG. 3, tabs 76 of terminals 60 and 62 are individually received in slots 96, 98 in actuator base 100, thereby positioning terminals 60, 62 within actuator 50, while isolating terminal 60 from terminal 62, when lamp 102 is removed.

As shown in FIG. 1, lamp terminals 60, 62 have a widened profile area 87 extending between the bent back portion 85 of the terminals 60, 62 and the narrow end 88, 90. The widened area 87 is received within opposing guides 89 located on sides 16, 20 of housing 12 to position and hold lamp terminals 60, 62. Pointed tabs 91 on opposing edges of widened profile 87 serve to grip the interior surface of guides 89 to aid securement of terminals 60, 62 within housing 12, prior to epoxy potting.

Lamp 102 may be any conventional light emitting device, such as a light emitting diode (LED), a wire lead miniature lamp, or similar device. Lamp 102 has conductive leads 104, 106 extending from its base 105. Leads 104, 106 are bent towards lamp 102 to generally conform to the profile of lamp 102 in 180° opposition. At assembly, lamp 102 is inserted between lamp end 74 of terminals 60, 62, with leads 104, 106 received in indentations 78 to releasably position and secure lamp 102 to lamp terminals 60, 62. Lamp leads 104, 106 do not need to be soldered or otherwise secured to terminals 60, 62, as opposing lamp terminals 60, 62 are sized and positioned to flex to releasably secure lamp 102 therebetween. Tweezers may be used to remove lamp 102 from between terminals 60, 62 after assembly for repair or replacement. A new lamp 102 may then be inserted between terminals 60, 62.

Where it is desired to mount a lighted switch 10 to a substrate by wave soldering (not shown), housing 12 with terminals 26, 28 preferably epoxied or molded in place, may be positioned on a substrate, such as a printed circuit board, with biased spring 30, actuator 50, lamp terminals 60, 62 and lamp 102 assembled therein.

To protect the parts assembled in housing 12, a tape seal or covering 108 may be secured over opening 24 to sides 16, 18, 20, 22. See FIGS. 1 and 3. With tape seal or covering 108 secured in place, terminals 26, 28, and lamp terminal ends 88, 90 extending from housing base 14 may be safely wave soldered by conventional means. Upon completion of wave soldering and substrate washing, tape seal or covering 108 may be removed, and the remainder of the switch components installed in preparation for use of switch 10.

Cap 110 is formed of a temperature resistant, non-conductive material, such as a glass filled polyester thermoplastic. Cap 110 has sides 112, 114, 116, 118 extending above housing 12 as shown in FIGS. 2A and 2B, with an upper bearing surface 120 located beneath sides 112-118, and sized to be closely received in housing opening 24. Sides 112-118 form an aperture 119 therebetween which extends through cap 110. Cap 110 also has opposing tabs 122, 124 extending beneath upper bearing surface 120, with engaging bosses 126, 128 located at the lower end of tabs 122, 124. Engaging bosses 126, 128 are guided into position by inclined slot sides 68, 70 on actuator 50. As tabs 122, 124 are inserted onto actuator 50, they are guided within slots 64, 66 in actuator 50 until at full insertion, bosses 126, 128 bias inward to engage base 53 of actuator 50. Cap 110 may thus be releasably secured to actuator 50, without removing housing 12 from the substrate. Cap 110 may be readily removed for access to lamp 102, and may be reinserted upon actuator 50 as previously disclosed.

Where a more decorative exterior finish is desired than is readily obtainable from temperature resistant cap 110 material; an outer shell 130 may be formed of a material exhibiting improved finish characteristics, such as ABS thermalplastic. Shell 130 may be formed with upper and lower opposed engaging means, 132, 134. Shell 130 is inserted over cap 110 until opposed lower engaging means 134 are biased beneath sides 114, 118, to secure shell 130 about cap 110.

Whether or not shell 130 is used to improve exterior appearance, a transclucent graphics insert 140 may be used to seal the exposed end of cap 110. Graphics insert 140 may be marked with graphics 142 such as pictures, letters or numbers in a manner to disclose the function of switch assembly 10, or for other identification purposes. Graphics 142 may be marked by a number of conventional means such as by molding, paint or ink. Graphics insert 140 is preferably made of a translucent lexan thermoplastic material.

Once assembled upon a substrate, nominal pressure upon graphics insert 140 will depress cap 110. Step 125 on cap 110 engages the top 72 of opposing sides 56, 58 of actuator 50 to limit travel of actuator 50 within housing 12. End 53 of actuator 50 depresses biased spring member 30 to provide electrical contact between terminal(s) 26, spring 30 and terminal(s) 28 during switch 10 actuation.

Lamp 102 may be externally energized independently of actuation of switch 10 by providing a suitable electrical voltage to lamp terminal leads 88, 90 extending from housing base 14; or terminal leads 88, 90 may be joined with terminal 28 and ground, in a manner to illuminate lamp 102 when cap 110 is depressed.

Thus, the lighted contact switch is suitable for use where miniaturization of the switching function is desired; where low cost and long life of the bearing surfaces are desired.

Therefore, while the invention has been described with reference to a particular embodiment, it is to be understood that modifications may be made without departing from the spirit of the invention or from the scope of the following claims.

INDUSTRIAL APPLICABILITY

This invention is intended for use as a lighted contact push switch. The switch is adapted to be flow soldered or otherwise directly attached to a substrate, such as a printed circuit board, or the like. This switch is adapted for use in a variety of electrical switch applications, including automotive use; use on electronic equipment; for extension through a panel; and for use where miniaturization of the switching function is desirable.

It is claimed:

1. A contact switch apparatus, which comprises:

(a) a non-conductive housing with a base and sides forming an aperture therebetween;

(b) a first conductive terminal disposed through the housing with a contact portion extending within the housing aperture;

(c) a conductive spring member disposed within the housing aperture adjacent to the first terminal means, the conductive spring member having a centrally raised spring portion in spaced relation between substantially flat side portions and adjoining substantially flat end portions, with the first conductive terminal means in continuous contact with at least one of the substantially flat side or end portions of the spring member;

(d) a second terminal disposed through the housing with a contact portion extending within the housing aperture in spaced proximity beneath the centrally raised spring portion of the spring member;

(e) an actuator means slidably disposed at least partially within the housing aperture, with a non-conductive biasing portion disposed adjacent to the centrally raised spring portion of the spring member; and (f) opposing conductive third terminals disposed in spaced relation through the housing with a portion formed to resiliently receive an illuminating means therebetween, and a tab positioned on the third terminals to limit travel of the actuator means between a second position wherein the actuator means is depressed to bias the centrally raised spring portion to make contact with the second terminal causing a closed circuit, and a first position wherein the actuator means is biased by the spring member to break electrical contact between the centrally raised portion of the conductive spring member and the second terminal.

2. The contact switch apparatus of claim 1, wherein a raised ridge is disposed across the substantially flat sides of the conductive spring member to resist straightening of the centrally raised spring portion during repeated switch actuation.

3. The contact switch apparatus of claim 1, wherein at least one boss is disposed on a flat portion of the conductive spring member adjacent to the first terminal to provide continuous contact between the boss on the conductive spring member and the first terminal.

4. The contact switch apparatus of claim 1, wherein the third terminal portion formed to resiliently receive an illuminating means therebetween is formed with lamp lead indentations therein; and an illuminating lamp with lamp leads is disposed between the opposed third terminals with the lamp leads formed to contact and releasably secure the lamp leads in the lamp lead indentations formed in the third terminals means, to provide electrical communication therebetween.

5. The contact switch apparatus of claim 4, wherein a switch cap is disposed at least partially within the housing aperture for resilient securement to the actuator means, the switch cap having sides forming a central aperture means, the switch cap having sides forming a central aperture therethrough sized to receive a portion of the third terminals therein, and a translucent insert is secured across the central aperture in spaced proximity to the illuminating lamp to transmit illumination through the translucent insert when the third terminals are electrically energized.

6. The contact switch apparatus of claim 5 wherein graphics selected from at least one of numerals, letters and symbols are disposed upon the translucent insert to aid in identification of a switching function.

7. An electrical contact switch apparatus for mounting to a substrate, which comprises:

(a) a non-conductive housing with a base and sides forming an aperture therebetween;

(b) a first conductive terminal disposed through the housing with a contact portion extending within the housing aperture;

(c) a conductive spring member disposed within the housing aperture, a portion of the spring member in continuous contact with the first terminal, the conductive spring member having a centrally raised spring portion thereon, with substantially flat sides disposed in spaced relation from the centrally raised portion, and with substantially flat ends connecting the sides and the centrally raised portion;

(d) a second terminal disposed through the housing with a contact portion within the housing aperture disposed in spaced relation beneath the centrally raised spring portion;

(e) a non-conductive actuator member with a base, and opposing sides disposed for slidable movement within the housing aperture, with the base of the actuator member disposed adjacent to the centrally raised spring portion of the conductive spring member;

(f) third opposing conductive lamp terminals disposed through the housing and extending into the housing aperture, with a portion of the lamp terminal formed to limit travel in an outward direction of the actuator member within the housing aperture;

(g) an illuminating lamp with leads formed to contact and secure the lamp between the third opposed lamp terminals;

(h) a non-conductive cap with sides forming a centrally disposed aperture therethrough; the cap with opposed tabs extending from the cap sides within the housing aperture to engage and releasably secure the cap to the actuator member; and (i) a translucent insert disposed and secured across the aperture in the cap in spaced relation from the illuminating lamp, wherein;

the non-conductive cap is manually actuated for slidable movement within the housing aperture to urge the actuator member against the centrally raised spring portion of the conductive spring member to make contact with the second terminal, providing electrical communication between the first terminal, the conductive spring member and the second terminal, and wherein the lamp terminals may be energized by a remote electrical power source to illuminate the lamp independently of actuation means.

8. The electrical contact switch apparatus of claim 7, wherein the substantially flat sides of the conductive spring member have a centrally disposed raised ridge extending across the sides, and the raised ridge is formed at an angle in relation to the centrally raised spring portion to resist straightening during repeated switch actuation.

9. The contact switch apparatus of claim 7, wherein a cap shell is adapted to be closely received and secured about the cap sides.

10. The electrical contact switch apparatus of claim 7, wherein the opposing sides of the actuator member form lower bearing surfaces slidably received within the housing opening, and the opposed tabs of the caps extending within the housing opening are configured with upper bearing surfaces slidably received within the housing opening to provide a spaced relation between upper and lower bearing surfaces to improve stability of the actuator member during actuation.

11. The electrical contact switch apparatus of claim 7, wherein the actuator member has a guide means disposed on opposed sides of the actuator member, with complementary guide means disposed upon the opposed tabs of the cap, to align the cap in relation to the actuator member during assembly.

12. The electrical contact switch apparatus of claim 7, wherein the opposed tabs of the cap are sized to be urged outward during insertion over the sides of the actuator member and upon complete insertion, the opposed tabs of the cap spring inward to releasably engage the opposed tabs of the cap beneath the opposed sides of the actuator member.

13. The electrical contact switch apparatus of claim 12, wherein a substantial pulling force on the cap will outwardly bias the assembled cap tabs, to release the cap from engagement with the opposed sides of the actuator member to expose the lamp for replacement without removing the lamp terminals from the substrate.

14. The electrical contact switch apparatus of claim 7, wherein a lamp lead indentation is formed on opposing lamp terminals to receive the lamp leads therein, to position and releasably secure the lamp between the opposed lamp terminals at assembly.

15. The electrical contact switch apparatus of claim 7, wherein the lamp may be removed from the lamp terminals to provide a non-lighted electrical contact switch, without effecting operation of the electrical contact switch assembly.

16. The apparatus of claim 7, wherein graphics, comprising at least one of symbols, numerals and lettering are marked upon the translucent insert to aid in identification of a switching function.

17. The apparatus of claim 7, wherein the cap is not installed until after flow soldering the terminals onto a substrate, and a tape barrier is temporarily secured to cover and seal the housing aperture during flow soldering, washing and cleaning.

18. An electrical contact switch apparatus having a housing, with base and sides forming an opening therebetween; a conductive spring means with a biased spring portion, the conductive spring means disposed within the housing opening; a first and second terminal disposed through the housing; the first terminal in continuous contact with the conductive spring means, and the second terminal aligned in spaced relation to the biased portion of the conductive spring means; an actuator means slidably disposed within the housing opening to bias the spring portion of the conductive spring means when the actuator means is manually biased, wherein the improvement comprises:

opposed lamp terminals disposed in spaced relation within the housing opening, with a portion extending through the housing, a portion of the lamp terminals formed to limit travel of the actuator means in an outward direction, and a portion of the lamp terminals formed to closely receive an illuminating lamp therebetween; and, an illuminating lamp with external leads formed to contact and releasably secure the illuminating lamp between the lamp terminals at assembly to provide electrical contact therebetween, wherein: the lamp terminals may be energized from a remote electrical energy source independently of actuation of the contact switch.

19. An electrical contact switch apparatus of claim 18, further comprising a cap with sides forming an aperture therebetween and opposed tabs extending at least partially within the housing openings, wherein the tabs are adapted to releasably engage and secure the cap to the actuator means at assembly; and a translucent insert is secured across the cap aperture to illuminate the insert when the lamp is energized.

20. The apparatus of claim 19, wherein markings selected from at least one of graphics, numerals and letters, are marked upon said translucent insert to identify a switching function.

* * * * *